US006314875B1

(12) United States Patent
Steenbergen

(10) Patent No.: US 6,314,875 B1
(45) Date of Patent: Nov. 13, 2001

(54) METHOD FOR APPLYING A REMOVABLE PRINTED MARKING TO A CONTAINER

(75) Inventor: Johannes Femminus Steenbergen, Ommen (NL)

(73) Assignee: Heineken Technical Services B.V., Amsterdam (NL)

( * ) Notice: Subject to any disclaimer, the term of this patent is extended or adjusted under 35 U.S.C. 154(b) by 0 days.

(21) Appl. No.: 09/125,552

(22) PCT Filed: Feb. 27, 1997

(86) PCT No.: PCT/NL97/00093

§ 371 Date: Feb. 1, 1999

§ 102(e) Date: Feb. 1, 1999

(87) PCT Pub. No.: WO97/32293

PCT Pub. Date: Sep. 4, 1997

(30) Foreign Application Priority Data

Mar. 1, 1996 (NL) ..... 1002508

(51) Int. Cl.[7] ..... B41C 1/06
(52) U.S. Cl. ..... 101/34; 15/277
(58) Field of Search ..... 101/33, 34, 35, 101/483; 15/277, 384, 387

(56) References Cited

U.S. PATENT DOCUMENTS 4,326,350 * 4/1982 Roske ..... 40/310
4,444,839 * 4/1984 Dudzik et al. ..... 428/336
5,094,912 * 3/1992 Deibig et al. ..... 428/355
5,320,693 6/1994 Helf .
5,335,596 * 8/1994 DeMoore et al. ..... 101/350

FOREIGN PATENT DOCUMENTS 20 43 486 A 3/1971 (DE) .
44 33 006 A 3/1996 (DE) .
0 019 977 A 12/1980 (EP) .
0 049 483 A 4/1982 (EP) .
0 316 676 A 5/1989 (EP) .
0 326 039 A 8/1989 (EP) .
2 259 291 A 3/1993 (GB) .

* cited by examiner

*Primary Examiner*—Ren Yan
(74) *Attorney, Agent, or Firm*—Pearne & Gordon LLP

(57) ABSTRACT

For the application of a removable printing to a container, such as a plastic crate, a layer of ink, which forms the printing and is provided on one side with a bonding agent for bonding the layer of ink to the container, is transferred to the container from a carrier film to which the layer of ink has been applied to the side not provided with bonding agent. The bonding agent has such properties that in normal conditions of use of the container the layer of ink adheres firmly to the container and in predetermined conditions which differ from the conditions of use the bonding agent and the layer of ink are easy to remove from the container. This produces a container with a high-quality printing, which printing is easy to replace with another printing.

26 Claims, No Drawings

METHOD FOR APPLYING A REMOVABLE PRINTED MARKING TO A CONTAINER

FIELD OF THE INVENTION

The invention relates to a method for applying a removable printing to a container.

BACKGROUND OF THE INVENTION

Applying a printing to a container, for example a bottle crate, is generally known. The printing can be applied to the container by flexographic printing or screen printing techniques. However, such a printing is of a permanent character and cannot be removed from the container, or can be removed only by very special measures.

In practice, there is a need for applying a different printing to a certain type of container (for example, if a different product is to be packed therein, or in the case of advertising promotions). For this purpose, the printing on the container must be relatively easy to remove from it without the container being damaged. On the other hand, the printing must be durable and of good optical quality, in order to ensure that a container can be used for a specific brand of product for quite a long period of time.

Labels which can be affixed to containers and removed from them again are known. Such labels contain a paper, aluminium or plastic film which is provided with a special layer of bonding agent. However, a container provided with such a label does not have a perfect appearance. Moreover, the thickness of such labels invites undesirable removal. During the industrial removal of labels from a large number of containers a relatively large quantity of material comes off and requires further processing.

BRIEF SUMMARY OF THE INVENTION

The object of the invention is to provide a method which makes it possible to apply an optically pleasing printing to a container, which printing is difficult for the user to remove from the container, but is easy to remove from the container industrially, the container being clean again after the printing has been removed, so that a new printing can be applied.

This object is achieved according to the invention by a method for applying a removable printing to a container, in which a layer of ink, which forms the printing and is provided on one side with a bonding agent for bonding the layer of ink to the container, is transferred to the container from a carrier film to which the layer of ink has been applied at the side not provided with bonding agent, the bonding agent having such properties that in normal conditions of use of the container the layer of ink adheres firmly to the container and in predetermined conditions which differ from the conditions of use the bonding agent and the layer of ink are easy to remove from the container.

Use of the method according to the invention produces a container with a high-quality printing which is relatively easy to replace by another printing.

The invention also relates to a plastic container provided with a removable printing comprising a layer of ink which forms the printing, which layer of ink is applied to the container by means of a bonding agent, the bonding agent having such properties that in normal conditions of use of the container the printing adheres firmly to the container and in predetermined conditions which differ from the conditions of use the bonding agent and the layer of ink are easy to remove from the container.

The invention also relates to a film to which a layer of ink which forms the printing is applied to one side, which layer of ink on the side facing away from the film is provided with a bonding agent for bonding the layer of ink to a substrate.

Preferred embodiments of the method, the plastic container and the film according to the invention are defined in the subclaims.

The invention will be explained in greater detail with reference to the exemplary embodiment below.

DETAILED DESCRIPTION OF INVENTION

The exemplary embodiment relates to the application of a removable printing to a plastic bottle crate which is preferably made of a polyalkene, such as polyethylene or polypropylene, and in which the printing is applied to the outside wall of the crate. However, the method according to the invention can also be used for other types of containers, such as plastic boxes and glass or plastic bottles.

When the method according to the invention is applied to a clean crate, a layer of ink, which forms the printing and is provided on one side with a bonding agent for bonding the layer of ink to the crate, is transferred from a carrier film to the crate. The layer of ink is applied to a carrier film at the side not provided with a bonding agent. The carrier film is preferably a calendered PET, polypropylene or polyethylene film with a thickness of 40–50 $\mu$m.

If the printing is being applied on an industrial scale, the printing will generally come from a carrier film web to which several layers of ink which form the printing have been applied. If the carrier film web has been placed on a roll, the side not provided with the printing will preferably be provided with an anti-bonding layer, for example a silicone layer. The printing will preferably be applied mechanically to the crates.

In order to be able to guarantee a perfect appearance and good protection of the printing, the layer of ink can be provided with a layer of lacquer on the side not provided with a bonding agent. Consequently, when the layer of ink has been applied to the carrier film, the layer of lacquer will be situated between the layer of ink and the carrier film. In order to guarantee optimum protection of the printing on a crate, the layer of lacquer projects beyond the contours of the layer of ink and is likewise provided with a bonding agent in that region, preferably the same bonding agent as that also applied to the layer of ink. Once the printing has been applied to the crate, the layer of ink is completely enclosed between the wall of the crate and the layer of lacquer.

In order to be able to remove the printing from the crate again relatively easily, the bonding agent has such properties that in normal conditions of use of the crate the layer of ink and the layer of lacquer adhere firmly to the crate and in predetermined conditions which differ from the conditions of use the bonding agent, the layer of ink and the layer of lacquer are easy to remove from the crate. An example is a bonding agent which loses its adhesion to the crate at a temperature which is higher than the temperature at which crates are usually cleaned. Crates are generally cleaned with water at a temperature of approximately 40° C. By using a bonding agent which becomes ineffective at a temperature of approximately 60° C. and higher, it is possible to allow crates from which the printing is to be removed to soak for some time in water at 60° C. and higher (to which an agent for reducing the surface tension has been added if necessary) and then to remove the printing using a high-pressure water jet (for example 15 bar).

In order to accelerate the soaking process, a slightly porous layer of ink and layer of lacquer, if present, can be used, so that water can penetrate rapidly to the bonding agent.

It is also possible to use a bonding agent which becomes ineffective under the influence of UV rays. In that case also, the printing can be removed using a high-pressure water jet.

The printing can be applied to the carrier film by means of conventional printing techniques, such as flexographic printing or screen printing techniques. This also applies to the layer of lacquer. In practice, a layer of lacquer will first be applied to the carrier film, with such dimensions that said layer of lacquer projects slightly beyond the layer of ink to be applied subsequently. The layer of ink will then be applied to the layer of lacquer and, finally, a bonding agent will be applied to the layer of ink and the part of the layer of lacquer projecting beyond the layer of ink, likewise using printing techniques.

The bonding between the layer of ink or layer of lacquer and the carrier film must, of course, be weaker than the bonding which the bonding agent produces between the layer of ink and layer of lacquer and the crate. This means that the layer of ink is easy to transfer from the carrier film to the crate without the layer of ink or the layer of lacquer being damaged. The bonding between the layer of ink or the layer of lacquer and the carrier film is the result of adhesion between the layer of ink or layer of lacquer and the carrier film.

As already mentioned, the layer of ink will generally be transferred mechanically from the carrier film to the crate. It must be ensured in this case that the layer of ink is pressed down well on the substrate, and that no air inclusions arise between the layer of ink and the crate wall.

The result of the application of the method according to the invention is a crate with a printing of very high quality, but which can easily be removed again, in such a way that after the removal of the printing the surface of the crate is undamaged, and a new printing can be applied to the crate.

Good results are obtained in practice with a dispersion glue manufactured by KIWO, known by the name of D 3206 VP, as the bonding agent. Of course, the invention is not limited to this bonding agent.

What is claimed is:

1. Method for applying a removable printing to a container, comprising the steps of providing a carrier film on which a layer of ink has been directly printed by means of conventional printing techniques, the layer of ink being provided on the side opposite the side facing said carrier film with an adhesive for bonding the layer of ink to the container, and transferring substantially the entire layer of ink and adhesive, which forms the printing, from the carrier film to the container, said adhesive having such properties that in normal conditions of use of the container the layer of ink adheres firmly to the container and in predetermined conditions which differ from the normal conditions of use the adhesive and the layer of ink are easy to remove from the container.

2. Method according to claim 1, in which the adhesive and the layer of ink can be removed together from the container.

3. Method according to claim 1, in which the bonding between the adhesive and the container substantially disappears at a temperature which is higher than the temperature at which containers are normally cleaned.

4. Method according to claim 3, in which the bonding between the adhesive and the container disappears at a temperature of approximately 60° C.

5. Method according to claim 1, in which the bonding between the adhesive and the container substantially disappears under the influence of UV rays.

6. Method according to claim 1, in which the carrier film is a carrier film web to which several layers of ink which form the printing have been applied.

7. Method according to claim 1, in which the layer of ink is transferred mechanically from the carrier film to the container.

8. Method according to claim 1, in which the printing is applied to a container made of plastic material.

9. Method according to claim 1, in which the container is a plastic crate or box and the printing is applied to the outside wall of the crate or the box.

10. Method for applying a removable printing to a container comprising the steps of providing a carrier film on which a layer of lacquer has been directly printed, said layer of lacquer having been provided with a layer of ink directly printed on said layer of lacquer by means of conventional printing techniques, the layer of ink being provided on the side opposite the side facing said carrier film with an adhesive for bonding the layer of ink to the container, and transferring substantially the entire layer of lacquer, ink, and adhesive, which forms the printing, from the carrier film to the container, said adhesive having such properties that in normal conditions of use of the container the layer of ink adheres firmly to the container and in predetermined conditions which differ from the normal conditions of use the adhesive and the layer of ink are easy to remove from the container.

11. Method according to claim 10, in which the layer of lacquer projects beyond the contours of the layer of ink, and the part of the layer of lacquer projecting beyond the layer of ink is provided with adhesive for bonding the corresponding part of the layer of lacquer to the container.

12. Method according to claim 10, in which the bonding between the layer of ink or the layer of lacquer and the carrier film is weaker than the bonding which the adhesive produces between the layer of ink and any part of the layer of lacquer which may project beyond the layer of ink and the container.

13. Method according to claim 10, in which the bonding between the adhesive and the container substantially disappears at a temperature which is higher than the temperature at which containers are normally cleaned.

14. Method according to claim 13, in which the bonding between the adhesive and the container disappears at a temperature of approximately 60° C.

15. Method according to claim 10, in which the bonding between the adhesive and the container substantially disappears under the influence of UV rays.

16. Method according to claim 10, in which the carrier film is a carrier film web to which several layers of ink which form the printing have been applied.

17. Method according to claim 10, in which the layer of ink is transferred mechanically from the carrier film to the container.

18. Method according to claim 10, in which the printing is applied to a container made of plastic material.

19. Method according to claim 10, in which the container is a plastic crate or box and the printing is applied to the outside wall of the crate or the box.

20. Method according to claim 8, wherein said container is made of a polyalkene.

21. Method according to claim 20, wherein said polyalkene is polyethylene.

22. Method according to claim 20, wherein said polyalkene is polypropylene.

23. Method according to claim 11, wherein the adhesive for bonding the corresponding part of the layer of lacquer to the container is the same as the adhesive on the layer of ink.

24. Method according to claim 18, wherein said container is made of a polyalkene.

25. Method according to claim 24, wherein said polyalkene is polyethylene.

26. Method according to claim 24, wherein said polyalkene is polypropylene.

* * * * *